US005924972A

United States Patent [19]

Turvaville et al.

[11] Patent Number: 5,924,972

[45] Date of Patent: Jul. 20, 1999

[54] PORTABLE D.C. POWERED CENTRIFUGE

[76] Inventors: L. Jackson Turvaville, 545 E. 3rd St. #2, Cookeville, Tenn. 38501; Elaine Mullen, 129 Frazier Rd., Crossville, Tenn. 38555; Fern King, 618 Stephens Rd., Grimsley, Tenn. 38565

[21] Appl. No.: 09/047,073

[22] Filed: Mar. 24, 1998

[51] Int. Cl.[6] ..... B04B 5/02; B04B 7/06

[52] U.S. Cl. ..... 494/11; 494/12; 494/16

[58] Field of Search ..... 494/11, 12, 16–21, 494/31, 33, 43, 60, 84, 85; 210/138, 781, 782

[56] References Cited

U.S. PATENT DOCUMENTS

| | | | |
|---|---|---|---|
| 1,769,889 | 7/1930 | McClaran et al. | 494/20 |
| 2,789,757 | 4/1957 | Melton | 494/20 |
| 2,820,590 | 1/1958 | Walker | 494/20 |
| 3,233,825 | 2/1966 | Lomb | 494/84 |
| 3,434,657 | 3/1969 | Luckham et al. | 494/84 |
| 3,567,113 | 3/1971 | Stansell et al. | 494/11 |
| 3,953,172 | 4/1976 | Shapiro et al. | 494/17 |
| 3,954,611 | 5/1976 | Reedy . | |
| 3,970,245 | 7/1976 | Aeschlimann | 494/11 |
| 4,412,831 | 11/1983 | Avery | 494/46 |
| 4,530,691 | 7/1985 | Brown | 494/45 |
| 4,636,193 | 1/1987 | Cullis | 494/45 |
| 4,738,655 | 4/1988 | Brimhall et al. | 494/16 |
| 4,889,524 | 12/1989 | Fell et al. | 494/12 |
| 4,924,770 | 5/1990 | Raub . | |
| 5,067,938 | 11/1991 | Uchida et al. | 494/12 |
| 5,387,174 | 2/1995 | Rochat | 494/10 |
| 5,505,683 | 4/1996 | Geringer et al. | 494/12 |

*Primary Examiner*—Charles E. Cooley
*Attorney, Agent, or Firm*—Pitts & Brittian, P.C.

[57] ABSTRACT

A portable eccentric centrifuge for the separation of compound fluid samples in areas where an external power source is not easily accessible and while being supported upon on a non-level surface. The portable eccentric centrifuge includes a compact, lightweight base plate supported by a plurality of adjustable legs connected height adjustment assembly for static leveling of the centrifuge. At least one level indicator permits adjustment along multiple axes for aligning the base plate in the horizontal plane. A lightweight, compact, lidded chamber secured to the base plate houses the d.c. motor driven centrifuge. A timer controls the length of the centrifuge operation. A d.c. power adaptor permits operation where a 12 volt d.c. power supply is available, such as from a vehicle's cigarette lighter receptacle.

13 Claims, 2 Drawing Sheets

PORTABLE D.C. POWERED CENTRIFUGE

TECHNICAL FIELD

This invention relates to the field of centrifuges. More specifically, this invention relates to the field of compact, lightweight, portable, d.c. powered, eccentric centrifuges.

BACKGROUND ART

Home health care practitioners routinely draw blood for analysis from homebound patients. Once drawn, whole blood begins to hemolyze resulting in chemical changes that affect testing accuracy. Inaccurate test results can cause the wrong treatment to be prescribed for the donor. Additionally, should the sample be identified as hemolyzed, another sample must be taken from the patient, increasing the risk of complications related to venipuncture such as infection, cellulitis, excessive bleeding, and blood clots. Further, multiple venipunctures could be necessary to acquire the necessary sample. Regardless of complications, each extra venipuncture subjects the donor to unnecessary pain.

To combat hemolysis, whole blood must be delivered to a laboratory for analysis within thirty minutes of being drawn. Accordingly, a home health care practitioner is typically required to go to a lab after each patient visit, even where multiple patients live within close proximity. This reduces the efficiency of the home health care practitioner and generates additional medical expenses in the form of additional time and mileage.

Another solution is to separate whole blood into its constituent components immediately, thereby stopping the hemolyzation process. However, this would require that a centrifuge be present after blood is drawn from the body. Conventional centrifuges are heavy, unwieldy devices unsuitable for use in the field.

Several devices have been produced to separate fluids using centrifugal forces. Typical of the art are those devices disclosed in the following U.S. Pat. Nos.:

| U.S. Pat. No. | Inventor(s) | Issue Date |
|---|---|---|
| 3,954,611 | Reedy | May 4, 1976 |
| 4,412,831 | Avery et al. | Nov. 1, 1983 |
| 4,530,691 | Brown | Jul. 23, 1985 |
| 4,636,193 | Cullis | Jan. 13, 1987 |
| 4,889,524 | Fell et al. | Dec. 26, 1989 |
| 4,924,770 | Raub | May 15, 1990 |
| 5,067,938 | Uchida et al. | Nov. 26, 1991 |
| 5,387,174 | Rochat | Feb. 7, 1995 |
| 5,505,683 | Geringer et al. | Apr. 9, 1996 |

It is desirable to have a portable centrifuge for use at remote locations. Several U.S. Letter patents disclose mobile centrifuges which, while being transportable, are not easily carried to locations frequented by a home health care practitioner. For example U.S. Pat. No. 3,954,611 discloses a mobile centrifuge device for separating clean oil from dirty oil. The '611 device requires mounting upon a truck or a trailer to achieve mobility. Similarly, U.S. Pat. No. 4,924,770 discloses a mobile juice extraction machine having a centrifuge for separating juice from pulp. The '770 device includes a cabinet-mounted juice extractor supported on casters for moving the cabinet to different locations within a grocery store. Although these devices are "mobile" in the sense that they may be rolled from one room to another within a structure, they are certainly not practical for use in the home health care industry as they are not easily transportable from one location to another, nor are they hand-held.

Additionally, the type of centrifuge needed depends upon the reason for drawing blood. For example, plasma donation involves separating red blood cells from the plasma. This process is also used in surgical procedures wherein blood lost by the patient is collected and separated, the red blood cells being reintroduced into the patient's vascular system to aid in the recovery process. Plasmapheresis typically employs a drum centrifuge comprising a separation bowl having exit holes near the top and spinning at high speeds. As the bowl spins, the lighter fluid is forced upward within the bowl and eventually out of the outlet ports while the heavier fluid remains within the drum to be evacuated through a drain, often to be returned to the donor, as indicated in the above examples.

Conversely, during blood sample analysis, a small amount of blood is separated into constituent components using an eccentric centrifuge. An eccentric centrifuge employs a plurality of counterbalanced separation tubes secured within a member rotating at high speeds. The separation tubes are placed at an angle with respect to the rotating axis, with the bottom end farther from the axis than the top. Thus, during operation of the centrifuge, heavier components of the fluid sink to the bottom while lighter components rise to the top of the tube for easy extraction and/or measurement.

U.S. Pat. Nos. 4,412,831; 4,530,691; 4,636,193; 4,889,524; 5,067,938; 5,387,174; and 5,505,683 disclose various centrifuge devices, adaptations and improvements. Primarily, these patents teach centrifuges not suited for being hand carried. For example, the '831 patent and the '938 patent teach the use of centrifuges mounted on rollers.

The '524 patent discloses a portable centrifuge designed for plasmapheresis and monitoring the status of both the system and the patient. The '524 device includes a drum centrifuge, a blood pump, an audible alarm, three air detectors, a microprocessor, cooling fans, a pressure sensor, and a pressurizing pump contained within a cabinet. Additionally, the '524 device does not provide a leveling device for use upon uneven surfaces. Further, the '524 device is designed to centrifuge blood pumped directly from the donor's vein and not to accept a blood sample drawn by a syringe. Finally, the '524 device is not suited for centrifuging the low volume blood samples typically used for analysis.

Therefore, it is an object of this invention to provide an eccentric centrifuge which is compact and lightweight so as to be easily portable.

Another object of this invention is to provide a centrifuge having a device for static leveling of the centrifuge on any surface.

A further object of this invention is to provide a centrifuge capable of using a d.c. power source, such as that provided by a car cigarette lighter receptacle.

DISCLOSURE OF THE INVENTION

Other objects and advantages will be accomplished by the present invention which serves to permit separation of compound fluid samples in areas where the external power source is a cigarette lighter receptacle and while being supported upon a non-level surface.

The centrifuge of the present invention includes a compact, lightweight base plate that serves as the foundation for the centrifuge. Static leveling of the centrifuge is accomplished using a height adjustment assembly which secures the base plate to plurality of adjustable legs. At least one level indicator permits adjustment along multiple axes for aligning the base plate in the horizontal plane. Finally, the base plate defines a plurality of tube holder openings for storing the separation tubes.

A lightweight, compact, chamber is secured to the base plate. The chamber is covered by a lid. Within the chamber, a d.c. motor is attached to a tube retention plate by a drive shaft. The tube retention plate secures the separation tubes during operation of the centrifuge. A timer controls the length of the centrifuge cycle. A d.c. power adaptor permits operation when plugged into a cigarette lighter receptacle.

The lid is secured by a lock assembly during operation and transit. Further, the lock assembly is electrically connected to the timer preventing operation of the centrifuge when not engaged.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

A portable eccentric centrifuge incorporating various features of the present invention is illustrated generally at 10 in the figures. The portable eccentric centrifuge, or centrifuge 10, is designed to be easily portable and operate in areas where 12 volt d.c. power is accessible. Moreover, in the preferred embodiment the centrifuge 10 is designed to provide an adjustment mechanism for leveling the centrifuge 10 when being supported upon on a non-level surface, such as on a vehicle seat, floorboard, console, or dashboard, and to operate using a d.c power source, such as a car cigarette lighter receptacle.

Figure 1:
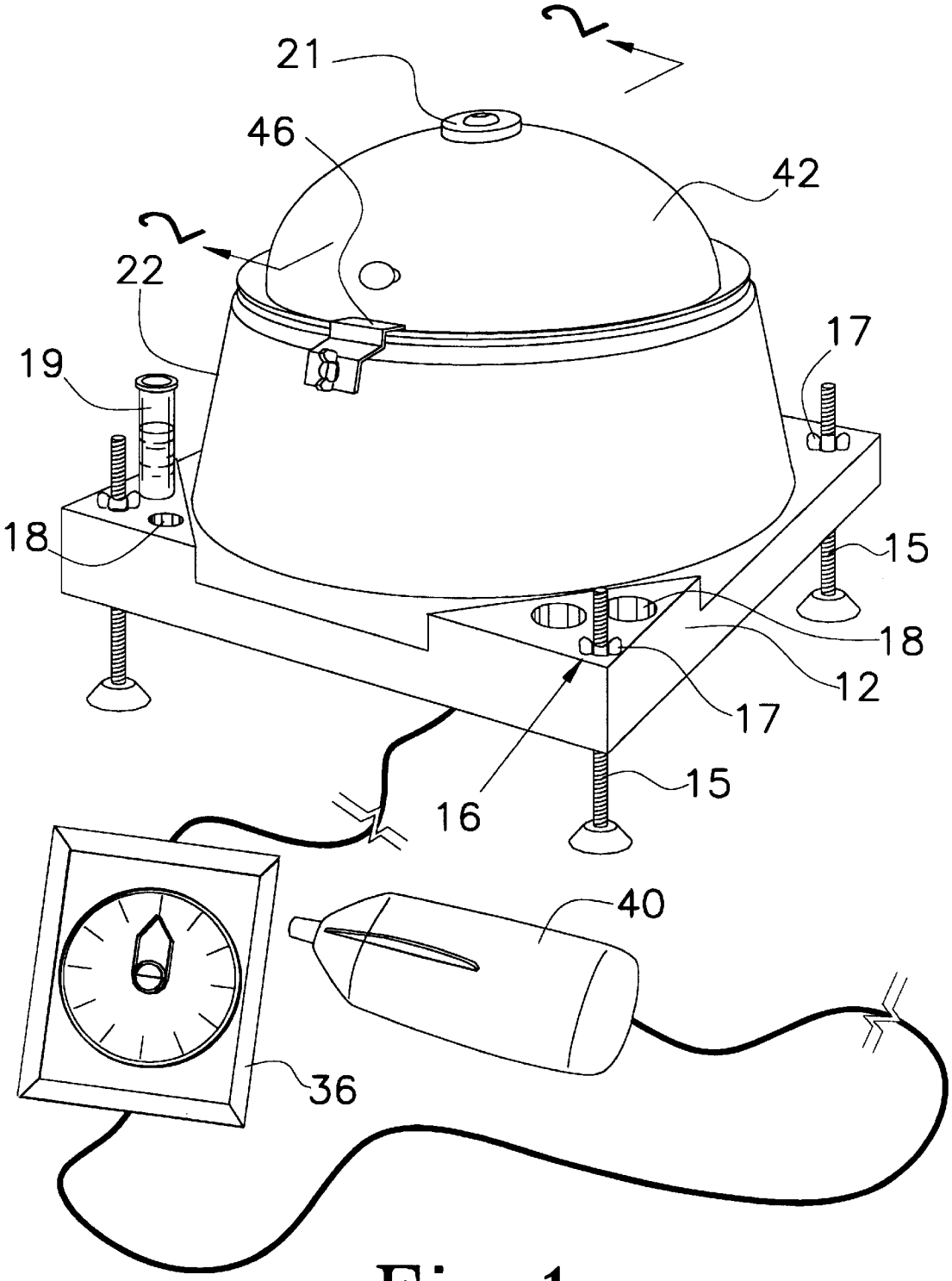
FIG. 1 is a perspective view of the portable eccentric centrifuge constructed in accordance with several features of the present invention showing.
Figure 2:
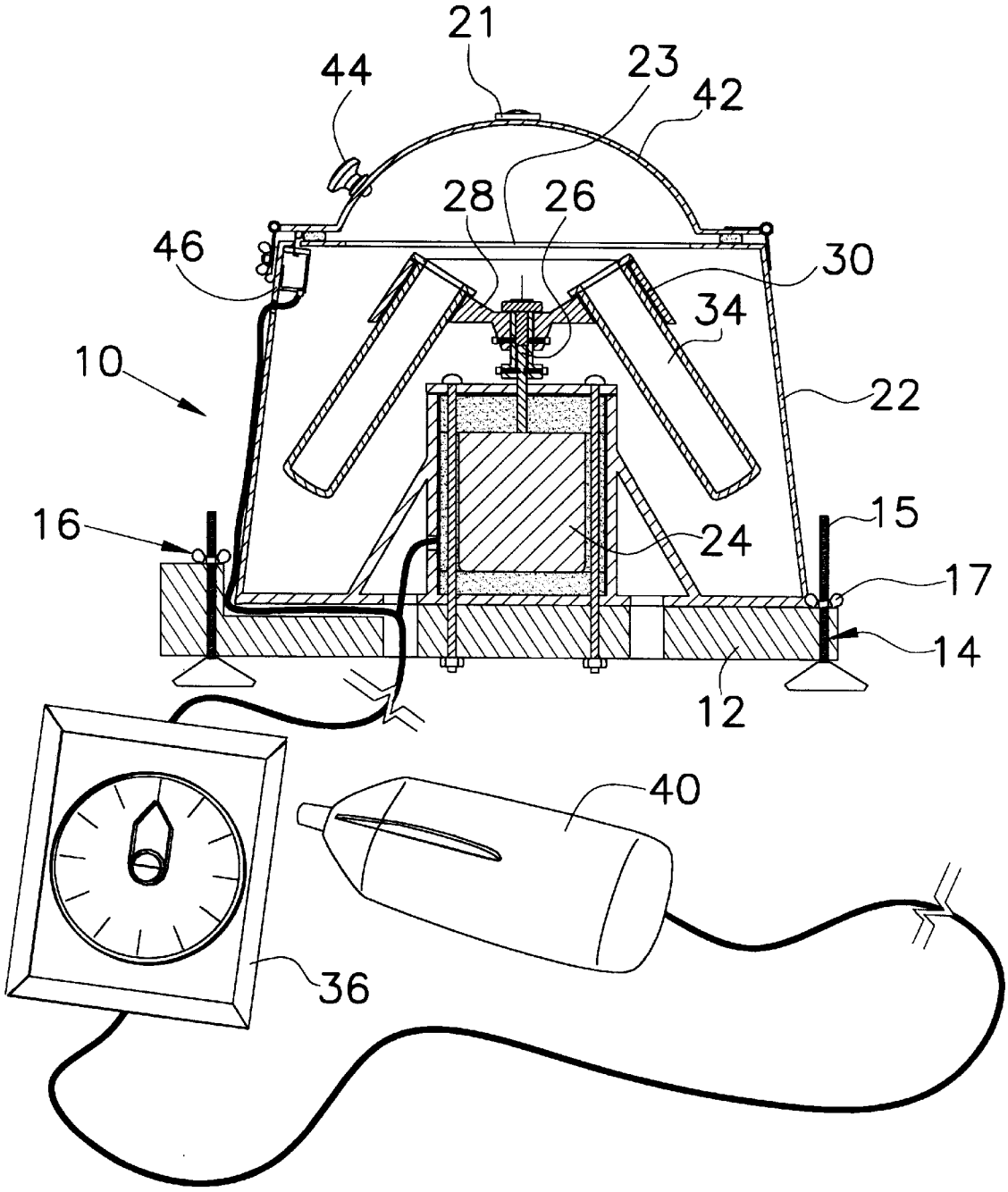
FIG. 2 illustrates a side elevation view, in section, of the portable eccentric centrifuge taken at 2—2 of FIG. 1.

FIG. 1 illustrates the centrifuge 10. However, details of the centrifuge are best illustrated in FIG. 2. A compact, lightweight base plate 12 serves as the foundation for the centrifuge 10. A plurality of stands 15 support the base plate 12. The base plate 12 defines a plurality of through-openings 14 for receiving the stands 15. Static leveling of the centrifuge 10 is accomplished using a height adjustment assembly 16 for adjusting the height at which the base plate 12 rests on each stand 15. For example, in the illustrated embodiment, each stand 15 defines a threaded portion and the height adjustment assembly 16 includes a threaded receptor 17, such as a wing nut. The threaded receptor 17 is secured to the base plate 12 at one end of each of the threaded through-openings 14 for engaging the threaded portion of each stand 15. Further, as shown in FIG. 1, at least one level indicator 21, such as a bubble level, indicates when the base plate 12 is statically level. In the illustrated embodiment of FIG. 1, a circular bubble level is disposed at the top of a lid 42 for aligning the base plate 12 in the horizontal plane. Finally, the base plate 12 defines a plurality of tube holder openings 18 for the storage of the separation tubes 19 for use with the centrifuge 10.

A lightweight, compact chamber 22, defining a lid opening 23, is secured to the base plate 12 and defines a volume for housing the centrifuge 10. Similarly, a d.c. motor 24 housed within the chamber 22 is secured to the base plate 12. A tube retention plate 28 is secured to the drive shaft 26 of the d.c. motor 24 and defines a plurality of tube openings 30 for receiving a plurality of separation tubes (not shown). The tube openings 30 are positioned such that the separation tubes can be placed to balance the tube retention plate 28. In the illustrated embodiment, the tube retention plate 28 defines two diametrically-opposed tube openings 30 for receiving two separation tubes. Further, in the illustrated embodiment, each tube opening 30 includes a tube sleeve 34 for receiving a separation tube.

A timer 36 is electrically connected to a d.c. motor 24 for controlling the length of the centrifuge cycle. In the illustrated embodiment, a d.c. power adaptor 40, for example an automobile cigarette lighter adaptor, permits operation from an automobile battery.

The lid 42 is secured to the chamber 22 covering the lid opening 23. A handle 44 is provided for gripping the lid 42 during opening and closing. A lock assembly 46 secures the lid 42 during operation and transit. In the illustrated embodiment, the lock assembly 46 is electrically connected to the timer 36 for preventing operation of the centrifuge 10 until the lock assembly 46 is engaged.

Due to the lightweight, compact construction, a home health care practitioner can have access to a portable centrifuge for use while traveling. For those patients requiring blood sample analysis, the practitioner can draw and separate whole blood eliminating the need for an immediate trip to a laboratory. Should the practitioner need to operate the centrifuge on a non-level surface, such as on a car seat or floorboard, the height adjustment assembly, in combination with the level indicator, provides the ability to statically level the centrifuge. For example, the practitioner could save time by operating the centrifuge, using the vehicle's 12 volt d.c power through the cigarette lighter adapter, while traveling between patient locations.

From the foregoing description, it will be recognized by those skilled in the art that a portable eccentric centrifuge offering advantages over the prior art has been provided. Specifically, the centrifuge provides a compact, lightweight, eccentric centrifuge which can be easily carried to remote locations. The centrifuge of the present invention provides a height adjustment mechanism for static leveling on uneven surfaces. Further, the centrifuge of the present invention utilizes a vehicle's 12 volt d.c. power source.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A centrifuge for separating a compound fluid into components for analysis, said centrifuge comprising:

a base plate;

a height adjustment device carried by said base plate, said height adjustment device being provided for leveling said base plate;

a chamber secured to said base plate;

a lid pivotally connected to said chamber for providing access to said chamber;

a d.c. motor conventionally secured to said base plate within said chamber, said d.c. motor being operated to rotate an output shaft;

a timer for controlling the length of a centrifuge cycle of said d.c. motor electrically connected to said motor;

a tube retention plate mounted on said d.c. motor output shaft for supporting a plurality of radially-spaced separation tubes for receiving at least one fluid sample to be analyzed, said plurality of separation tubes being disposed such as to be counterbalanced, said d.c. motor imparting rotation on said plurality of separation tubes such that individual components of the fluid sample are separated by centrifugal forces during a centrifuge cycle; and a d.c. power adapter for receiving power from a vehicle cigarette lighter receptacle electrically connected to said timer and said motor.

2. The centrifuge of claim 1 wherein said base plate defines at least one tube holder opening for receiving at least one of said plurality of separation tubes.

3. The centrifuge of claim 1 wherein said height adjustment device includes at least one adjustable support for leveling said base plate.

4. The centrifuge of claim 1 wherein said height adjustment device includes at least one level indicator for indicating when said base plate is level along at least one axis.

5. The centrifuge of claim 1 wherein said centrifuge includes a lock assembly for securing said lid to said chamber during transport and operation.

6. The centrifuge of claim 5 wherein said lock assembly is electrically connected to said timer preventing operation of said centrifuge when said lock assembly is not engaged.

7. The centrifuge of claim 1 wherein said tube retention plate is configured to support two diametrically-spaced separation tubes.

8. A centrifuge for separating a compound fluid into components for analysis, said centrifuge comprising:

a base plate;

a height adjustment device carried by said base plate, said height adjustment device including at least one adjustable support for leveling said base plate;

a chamber secured to said base plate;

a lid pivotally connected to said chamber for providing access to said chamber;

a lock assembly for securing said lid to said chamber during transport and operation;

a d.c. motor conventionally secured to said base plate within said chamber, said d.c. motor being operated to rotate an output shaft;

a timer for controlling the length of a centrifuge cycle of said d.c. motor electrically connected to said motor;

a tube retention plate mounted on said d.c. motor output shaft for supporting a plurality of radially-spaced separation tubes for receiving at least one fluid sample to be analyzed, said plurality of separation tubes being disposed such as to be counterbalanced, said d.c. motor imparting rotation on said plurality of separation tubes such that individual components of the fluid sample are separated by centrifugal forces during a centrifuge cycle; and a d.c. power adapter for receiving power from a vehicle cigarette lighter receptacle electrically connected to said timer and said motor.

9. The centrifuge of claim 8 wherein said base plate defines at least one tube holder opening for receiving at least one of said plurality of separation tubes.

10. The centrifuge of claim 9 wherein said height adjustment device includes at least one level indicator for indicating when said base plate is level along at least one axis.

11. The centrifuge of claim 9 wherein said lock assembly is electrically connected to said timer preventing operation of said centrifuge when said lock assembly is not engaged.

12. The centrifuge of claim 9 wherein said tube retention plate supports two diametrically-opposed separation tubes.

13. A centrifuge for separating a compound fluid into components for analysis, said centrifuge comprising:

a base plate, said base plate defining at least one tube holder opening, each said tube holder opening for receiving a separation tube;

a height adjustment device carried by said base plate, said height adjustment device including at least one adjustable support for leveling said base plate and at least one level indicator for indicating when said base plate is level along at least one axis;

a chamber secured to said base plate;

a lid pivotally connected to said chamber for providing access to said chamber; a d.c. motor conventionally secured to said base plate within said chamber, said d.c. motor being operated to rotate an output shaft; a timer for controlling the length of a centrifuge cycle of said d.c. motor electrically connected to said motor;

a lock assembly for securing said lid to said chamber during transport and operation, said lock assembly being electrically connected to said timer preventing operation of said centrifuge when said lock assembly is not engaged;

a tube retention plate mounted on said d.c. motor output shaft for supporting two diametrically-opposed said separation tubes for receiving at least one fluid sample to be analyzed, said separation tubes being disposed such as to be counterbalanced, said d.c. motor imparting rotation on said separation tubes such that individual components of the fluid sample are separated by centrifugal forces during said centrifuge cycle; and a d.c. power adapter for receiving power from a vehicle cigarette lighter receptacle electrically connected to said timer and said motor.

* * * * *